United States Patent [19]

Patuzzi et al.

[11] 4,234,171

[45] Nov. 18, 1980

[54] MIXING ARRANGEMENT

[75] Inventors: Alexander Patuzzi, Linz; Ernst Riegler, Enns; Manfred Schmidt, Linz, all of Austria

[73] Assignee: Voest-Alpine Aktiengesellschaft, Linz, Austria

[21] Appl. No.: 939,885

[22] Filed: Sep. 5, 1978

[30] Foreign Application Priority Data

Sep. 29, 1977 [AT] Austria ..... 6936/77

[51] Int. Cl.[3] ..... C21B 3/00

[52] U.S. Cl. ..... 266/248; 266/276

[58] Field of Search ..... 266/276, 277, 245, 244, 266/246, 248, 142, 143, 167, 173, 213, 240, 900

[56] References Cited

U.S. PATENT DOCUMENTS

| | | | |
|---|---|---|---|
| 223,481 | 1/1880 | Chapin | 266/248 |
| 708,783 | 9/1902 | Schwartz | 266/245 |
| 1,815,605 | 7/1931 | Allen | 266/277 |
| 2,599,158 | 6/1952 | Brassert | 266/248 |
| 2,696,663 | 12/1954 | Wright et al. | 266/142 |
| 3,039,627 | 6/1962 | Sayre et al. | 214/44 |
| 3,312,457 | 4/1967 | Schweinsberg et al. | 266/248 |
| 3,367,647 | 2/1968 | Dain | 266/246 |
| 3,459,068 | 8/1969 | Mähringer et al. | 266/245 |
| 3,494,602 | 2/1970 | Shindo | 266/248 |
| 3,606,986 | 9/1971 | Greenberg | 266/248 |
| 3,730,506 | 5/1973 | McAfee | 266/275 |
| 3,746,328 | 7/1973 | Martt | 266/276 |
| 3,831,917 | 8/1974 | Moser | 266/247 |
| 3,838,650 | 10/1974 | Dutko et al. | 266/276 |
| 3,897,936 | 8/1975 | Berthold et al. | 259/89 |

*Primary Examiner*—L. Dewayne Rutledge
*Assistant Examiner*—Peter K. Skiff
*Attorney, Agent, or Firm*—Brumbaugh, Graves, Donohue & Raymond

[57] ABSTRACT

In a mixing arrangement including a tiltable mixer provided with a refractory lining and having a horizontally arranged cylindrical mixing chamber with end walls, the mixing chamber is mounted on a base by means of a fixed bearing and an expansion bearing and is supported on the base by means of two aligning carrying trunnions connected to the end walls, one of the carrying trunnions being mounted in the expansion bearing and the other being mounted in the fixed bearing.

12 Claims, 8 Drawing Figures

MIXING ARRANGEMENT

BACKGROUND OF THE INVENTION

The invention relates to tiltable mixers provided with a refractory lining, in particular large-space pig iron mixers, comprising a cylindrical mixing chamber horizontally arranged and having end walls, which mixing chamber is mounted on the base by means of a fixed bearing and an expansion bearing.

It has been known to support pig iron mixers on the base with two spaced-apart raceways fastened to the jacket of the mixing chamber, one of which raceways is mounted in a fixed bearing and the other in an expansion bearing. The raceways are mounted on rollers, the latter being guided by means of cages that are displaceable between the base and the raceways. In order to reach a synchronous movement of the rollers of the fixed bearing side with those of the expansion bearing side, i.e. in order to prevent slanting or travelling of the pig iron mixer to one side, the cages of the expansion and the fixed bearings have to be connected with each other by transverse connections extending parallel to the longitudinal axis of the vessel. A plurality of X-shaped cross-struts is used for that type of connection. Despite those cross-struts, it is not possible in practice to actually reach a synchronous movement of the rollers of the expansion bearing with those of the fixed bearing because, due to differences in the lubrication, the thermal stresses that occur during charging, and discharging as well as unequal friction conditions, relative movements between the rollers of the fixed and expansion bearing sides cannot be totally excluded. Between the roller cages and the rollers play must always be present, so that slanting of the rollers and thus travelling and slanting of the vessel cannot be prevented, despite the cross struts. Slanting of the vessel and the rollers can lead to self-blockage of the rollers, so that the vessel cannot be moved by means of a tilting drive. Due to the line contact of the rollers with the raceways, a vessel, once slanted cannot slide back into its normal position on its own. It happens in fact that, with roller mounted pig iron mixers, when the vessel becomes greatly slanted during a period of several months, it has to be pressed back into its normal position with big hydraulic presses.

In order to avoid these disadvantages and difficulties and according to one proposal, the expansion bearing and the fixed bearing are designed as slide bearings, with the raceways resting on arcuate slideways formed of a plurality of slide plates. Here, the difficulty arises from having to allow the slide plates to contact the arcuate slideways with a certain pressure, i.e. from adjusting a certain pressure distribution over the length of the slideways. In particular, if the slideways deviate from the ideal form of a circular arc—which practically is often the case due to inaccuracies in the production and deformations during operation of a pig iron mixer—not all slide plates will participate in accommodating the load, i.e. some slide plates are subjected to early wear and other slide plates lying between those slide plates are hardly worn at all. A further difficulty is to be seen in the fact that even with ideal circular-arc shaped slideways, adjustment of the slide plates to the shape of the slideways can be carried out only with difficulty and an excessive amount of time.

For further improving and developing the mounting of pig iron mixers it has been proposed to support the slide plates hydraulically. To realize this proposal, a complex construction is required.

If it is desired to use the above-described bearing constructions for tiltable large-space pig iron mixers, whose mixing chambers have diameters of about 10 to 15 meters, the moments at the tilting axis caused by the frictional forces and counteracting the movement of the mixing chamber will appear to be very big. Even with careful mounting according to the above-described proposals, a high portion of the performance capability of the drive motors will have to be used simply for overcoming the frictional forces of the bearings acting at the circumference of the mixing chamber. An increase in the friction with large-space pig iron mixers also occurs because the production of the roller paths and slideways, which have large diameters, cannot be carried out with the tight tolerances that are necessary for an exact mounting.

This high "friction performance portion" must also be taken into consideration when dimensioning the drives, so that, from a certain mixer size onwards, the whole drive has to be designed for a friction performance portion that is disproportionally high compared to the performance portion due to weight and inertia.

A further disadvantage of the known mixer bearings is to be seen in that the production and checking (e.g. measuring) of the roller paths and slideways arranged at the circumference of the mixing chamber is material, time and money consuming. Moreover, the slideways are directly subjected to the changes in shape caused by the deformations of the mixing chamber during operation, whereby the frictional conditions at the bearings, in particular with mixers having large diameters, will deteriorate.

SUMMARY OF THE INVENTION

The present invention aims at avoiding these disadvantages and difficulties and has as its object to provide a mixer of the initially-defined kind with which the portion of the drive performance necessary for overcoming the frictional forces is considerably reduced so that it is possible to produce large-space pig iron mixers whose drive gearing and drive motors can be dimensioned initially according to the weight and moment of inertia of the pig iron mixer. In particular the frictional force moments at the bearings are to be lowered to a fraction, e.g. to about 1/10, of the moments occurring with pig iron mixers mounted in a conventional way.

This object is achieved according to the invention in that the mixing chamber is supported on the base by means of two aligned carrying trunnions engaging its end walls, one of which carrying trunnions is mounted in an expansion bearing and the other in a fixed bearing. By this means, it is possible to arrange those bearing elements that cause the friction during tilting of the mixer considerably closer to the tilting axis of the mixer, so that the moment caused by those forces is also considerably reduced. A further advantage is that the parts of the bearing can be produced in a much simpler and more precise manner, due to the greatly reduced diameter of the bearing. Because of the arrangement of the bearings at the end walls of the mixer, deformations of the mixer walls have no remarkable impact on the friction conditions of the bearing.

Preferably, the carrying trunnions are either fastened to the end walls of the mixing chamber so as to be secured against rotation and rotatably mounted relative to the base, or are fastened to the base so as to be secured against rotation and rotatably mounted relative to the mixing chamber.

Advantageously, the axes of the carrying trunnions are arranged eccentrically to the axis of the mixing chamber.

According to a preferred embodiment, the end walls of the mixing chamber are provided with reinforcement ribs that extend radially from the carrying trunnions to the periphery of the mixing chamber, wherein the reinforcement ribs arranged opposite each other are suitably connected by means of longitudinal ribs extending parallel to the axis of the mixing chamber and contacting the jacket of the mixing vessel, thus ensuring a favourable introduction of the forces into the carrying trunnions and rings fastened to the end walls.

It has proved advantageous to have slide articulation bearings provided as the trunnions bearings.

An advantageous driving mode is characterized in that at least one carrying trunnion is provided with a gear wheel of a tilting drive, thus it being possible to arrange all drive elements outside the danger zone of the mixer.

According to another advantageous embodiment, the tilting drive comprises at least one drive element engaging the jacket of the mixing chamber, wherein it is suitable, if two pinions are provided as the drive element. The pinions engage a stub tooth unit mounted to the jacket of the mixing chamber and are driven via a torque-dividing gearing.

BRIEF DESCRIPTION OF THE DRAWINGS

The invention will now be explained in more detail by way of several embodiments and with reference to the accompanying drawings of schematic representations of the invention, wherein.

DESCRIPTION OF PREFERRED EMBODIMENTS

Figure 1:
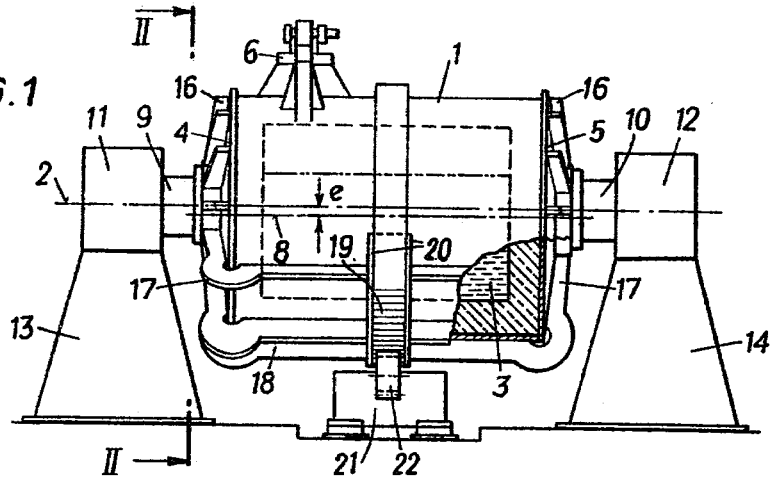
FIG. 1 is a side view.
Figure 2:
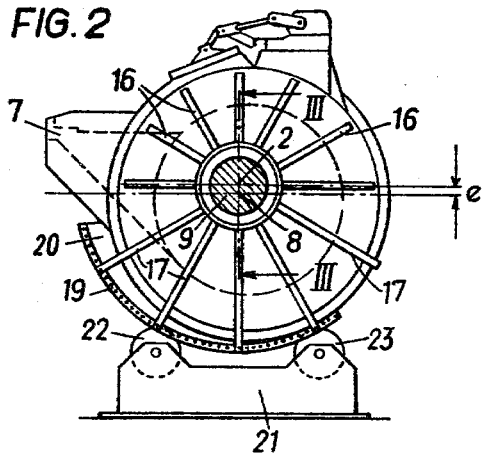
FIG. 2 is a sectional view along II—II of FIG. 1.

A cylindrical jacket 1 of a mixing chamber 3 of a large-space pig iron mixer is tiltable about a horizontal axis 2. The jacket is provided with a refractory lining and is terminated by end walls 4 an 5 that bow towards the outside of the chamber. At the circumference of the mixing chamber a filling opening 6 and a pouring opening 7 are provided. The mixing chamber 3 furthermore may be provided with heating means not illustrated. Concentric with the tilting axis 2, which is eccentrically arranged with respect to a cylinder axis 8 of the mixing chamber by an amount "e", are carrying trunnions 9, 10 that engage the end walls 4, 5. The carrying trunnion denoted by 9 is mounted in an expansion bearing 11 and the carrying trunnion denoted by 10 is mounted in a fixed bearing 12.

Figure 3:
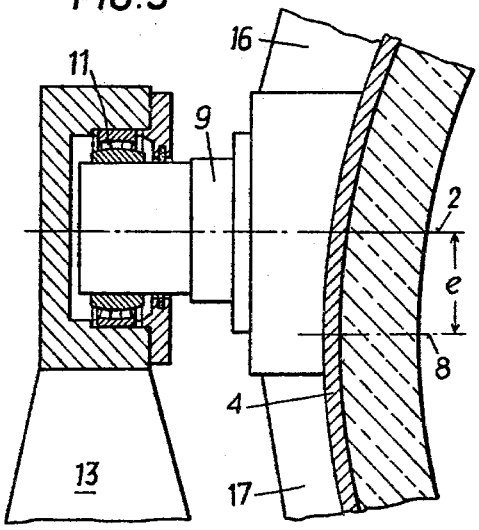
FIG. 3 is a detailed section along line III—III of FIG. 2 on an enlarged scale, of one embodiment according to the invention.
Figure 4:
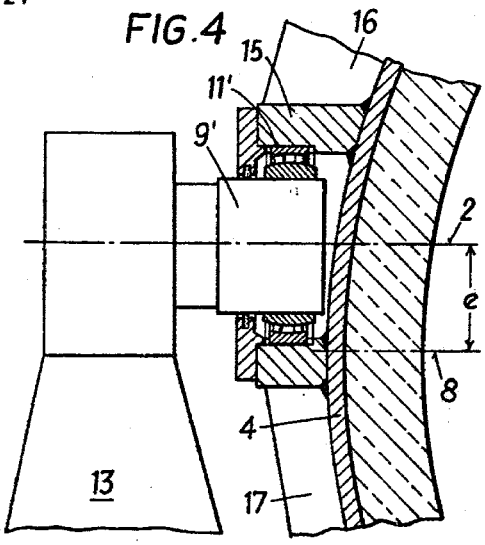
FIG. 4, in an analogous illustration to FIG. 3, shows a modified embodiment according to the invention.

According to the embodiment illustrated in more detail in FIG. 3, the carrying trunnions 9, 10 are rigidly fastened to the end walls 4, 5 and are mounted in slide articulation bearings 11, 12 which are each inserted in base supports 13, 14. In FIG. 4 an embodiment is illustrated in which one carrying trunnion 9' has one end immovably fastened to the base support 13 and the other end, which is directed to the end wall 4, mounted via a slide articulation bearing 11' accommodated within a ring 15 rigidly fastened to the end wall 4, for instance welded thereto. With both embodiments, one of the two slide articulation bearings is designed as a fixed bearing and the other as an expansion bearing. For determining the weight of the amount of pig iron present in the pig iron mixer, the bearings can be placed on load cells, or the load cells can be provided within the slide articulation bearings in such a way that the slide elements of the bearings are equipped with load cells. Instead of the slide articulation bearings, also other bearings, for instance antifriction bearings, can be provided.

For strengthening the walls of the mixing chamber 3, reinforcement ribs 16, 17 are provided at the end walls 4, 5, extending from the carrying trunnions 9, 10 radially to the periphery of the mixing chamber. The oppositely arranged reinforcement ribs 17 of the two end walls, which are directed towards the lower side of the mixing chamber 3, are connected by means of longitudinal ribs 18 directed parallel to the axis 8 of the mixing chamber 3. These ribs 18 support the cylindrical jacket 1 of the mixing chamber. By this arrangement, a kind of supporting cage reinforcing the mixing chamber walls is formed.

According to the embodiment illustrated in FIGS. 1 to 4, a lantern gear toothing is provided for the tilting drive of the pig iron mixer. Stub tooth units 19 of the drive are mounted concentrically with respect to the tilting axis 2 on flanges 20 that are fastened to the middle of the cylindrical jacket 1. The drive motor together with the reduction gear are combined into a construction unit 21 arranged below the mixing chamber 3 and thus protected by the mixing chamber 3. The reduction gear is designed as a torque-dividing gear for driving two pinions 22, 23 meshing with the stub tooth units, which pinions are arranged at a distance from each other in the circumferential direction of the mixing chamber. The drive includes an emergency drive motor, which is not illustrated.

Figure 5:
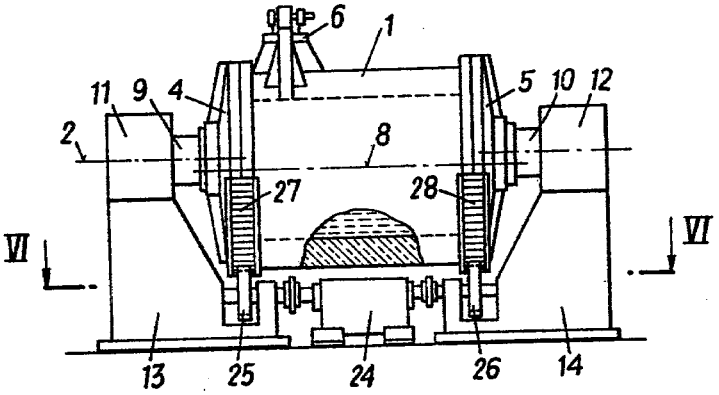
FIG. 5 shows a further embodiment according to the invention, illustrated in the same way as in FIG. 1.
Figure 6:
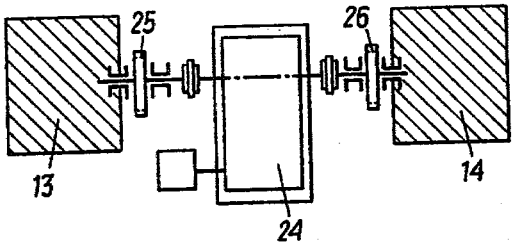
FIG. 6 shows a section along line VI—VI of FIG. 5.

The embodiment illustrated in FIGS. 5 and 6 differs from the embodiment illustrated in FIG. 1 with regard to the configuration of the drive. A torque-dividing drive 24 is provided to drive two pinions 25, 26 that engage in two stub tooth units 27, 28 arranged in the region of the end walls 4, 5 of the jacket 1 of the mixing chamber.

With this arrangement of the stub tooth units 27, 28 and the pinions 25, 26, it is possible to introduce the forces that are necessary for tilting the vessel in the vicinity of the bearings of the mixing chamber 3, thus reducing the danger of canting of the mixing chamber during tilting, as compared to a drive engaging nearer to the middle of the mixing chamber. Also here, the drive is arranged below the mixing chamber so as to save space.

Figure 7:
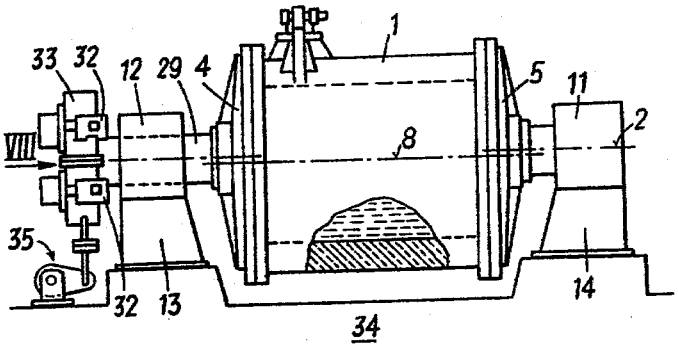
FIGS. 7 and 8 represent a further embodiment according to the invention, FIG. 7 showing a side view analogous to FIG. 1, and FIG. 8 being a front view in the direction of the arrow VIII of FIG. 7.
Figure 8:
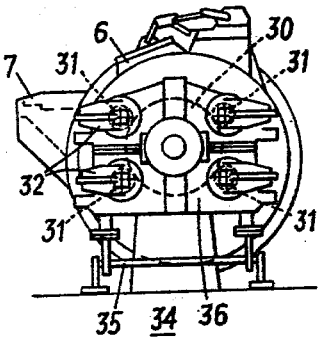

In FIGS. 7 and 8 a further possibility of a particularly suitable embodiment of a drive for a mixer according to the invention is illustrated. According thereto, one of the carrying trunnions, preferably the carrying trunnion 29 mounted in the fixed bearing 12 and connected to the end wall 4 so as to be secured against rotation, with respect to wall 4, is elongated beyond the base support 13 and is connected to a spur gear wheel 30 so as to be secured against rotation with respect to that wheel. Four pinions 31 distributed about the circumference of the spur gear wheel 30 engage in the latter, each of these pinions being drivable by means of a separate drive motor 32. A drive casing 33 is overmounted on the carrying trunnion 29 and supported relative to the base 34 by a torque support, which is denoted by 35. This embodiment of the mixing drive has the advantage that the driving parts can be arranged outside the "hot zone" and thus outside the area of danger of the mixer.

The mixing vessel according to the invention can be provided also with other drives, e.g. with a toothed rack engaging at the jacket of the mixing chamber.

What we claim is:

1. In a mixing arrangement of the type including: a fixed base; a tiltable large-space pig iron mixer provided with a refractory lining and having a cylindrical mixing chamber of about 10 to 15 meters in diameter, said cylindrical mixing chamber being horizontally arranged and having opposite end walls and a cylindrical jacket; and bearing means including a fixed bearing and an expansion bearing supporting said cylindrical mixing chamber, the improvement comprising:

two aligning carrying trunnions with first and second ends, each trunnion having its first end fixedly connected to a respective one of said end walls so as to be secured against rotation relative to said end walls, one of said two aligning carrying trunnions having its second end rotatably mounted in said fixed bearing, which is mounted on said fixed base, and the other of said aligning carrying trunnions having its second end rotatably mounted in said expansion bearing, which is mounted on said fixed base, so as to support said cylindrical mixing chamber on said fixed base;

reinforcement ribs provided at said end walls and extending from said aligning carrying trunnions radially to the periphery of said cylindrical mixing chamber; and longitudinal ribs extending along the jacket of said cylindrical mixing chamber parallel to its axis and connecting at least some of said reinforcement ribs arranged on opposite end walls to form a supporting cage for said cylindrical mixing chamber.

2. A mixing arrangement as set forth in claim 1, wherein the axes of said aligning carrying trunnions are arranged to be eccentric relative to the longitudinal axis of said cylindrical mixing chamber, i.e. parallel to, but offset from, said chamber longitudinal axis.

3. A mixing arrangement as set forth in claim 1, wherein said fixed bearing and said expansion bearing are slide articulation bearings.

4. A mixing arrangement as set forth in claim 1, further comprising a tilting drive with a gear wheel, said gear wheel being provided on at least one of said aligning carrying trunnions.

5. A mixing arrangement as set forth in claim 1 further comprising a tilting drive having at least one drive element engaging at the jacket of said cylindrical mixing chamber.

6. A mixing arrangement as set forth in claim 5 wherein said tilting drive includes a stub tooth unit mounted on the jacket of the cylindrical mixing chamber, and said at least one drive element comprises two pinions, said two pinions engaging in said stub tooth unit, a torque-dividing gear being provided, said two pinions being drivable by said torque-dividing gear.

7. In a mixing arrangement of the type including: a fixed base; a tiltable large-space pig iron mixer provided with a refractory lining and having a cylindrical mixing chamber of about 10 to 15 meters in diameter, said cylindrical mixing chamber being horizontally arranged and having opposite end walls and a cylindrical jacket; and bearing means including a fixed bearing and an expansion bearing to support said cylindrical mixing chamber, the improvement comprising:

two aligning carrying trunnions with first and second ends, each trunnion having its first end fastened to said fixed base so as to be secured against rotation relative to said base, one of said two aligning carrying trunnions having its second end rotatably mounted in said fixed bearing, which is fixed on a respective end wall, and the other of said aligning carrying trunnions having its second end rotatably mounted in said expansion bearing, which is fixed on the other end wall, so as to support said cylindrical mixing chamber on said fixed base;

reinforcement ribs provided at said end walls and extending radially to the periphery of said cylindrical mixing chamber; and longitudinal ribs extending along the jacket of said cylindrical mixing chamber parallel to its axis for connecting at least some of said reinforcement ribs arranged on opposite end walls to form a supporting cage for said cylindrical mixing chamber.

8. A mixing arrangement as set forth in claim 7, wherein the axes of said aligning carrying trunnions are arranged to be eccentric relative to the longitudinal axis of said cylindrical mixing chamber, i.e. parallel to, but offset from, said chamber longitudinal axis.

9. A mixing arrangement as set forth in claim 7, wherein said fixed bearing and said expansion bearing are slide articulation bearings.

10. A mixing arrangement as set forth in claim 7, further comprising a tilting drive with a gear wheel, said gear wheel being provided on at least one of said aligning carrying trunnions.

11. A mixing arrangement as set forth in claim 7, further comprising a tilting drive having at least one drive element engaging at the jacket of said cylindrical mixing chamber.

12. A mixing arrangement as set forth in claim 11, wherein said tilting drive includes a stub tooth unit mounted on the jacket of the cylindrical mixing chamber, and said at least one drive element comprises two pinions, said two pinions engaging in said stub tooth unit, a torque-dividing gear being provided, said two pinions being drivable by said torque-dividing gear.

* * * * *